US009327953B2

(12) United States Patent
Sayles

(10) Patent No.: US 9,327,953 B2
(45) Date of Patent: May 3, 2016

(54) SAFE ZONE DETECTION SYSTEM FOR LIFT HAVING A PLUARLITY OF SENSORS

(71) Applicant: BALLYMORE COMPANY, INC, Parkesburg, PA (US)

(72) Inventor: John Sayles, West Chester, PA (US)

(73) Assignee: BALLYMORE COMPANY, INC., Parkesburg, PA (US)

( * ) Notice: Subject to any disclaimer, the term of this patent is extended or adjusted under 35 U.S.C. 154(b) by 694 days.

(21) Appl. No.: 13/625,653

(22) Filed: Sep. 24, 2012

(65) Prior Publication Data

US 2013/0075203 A1 Mar. 28, 2013

Related U.S. Application Data

(60) Provisional application No. 61/538,696, filed on Sep. 23, 2011.

(51) Int. Cl.

| | |
|---|---|
| ***B66F 9/20*** | (2006.01) |
| ***B66F 17/00*** | (2006.01) |
| ***B66F 11/04*** | (2006.01) |

(52) U.S. Cl.

CPC ..... *B66F 17/006* (2013.01); *B66F 11/04* (2013.01)

(58) Field of Classification Search

CPC ..... B66F 17/006; B66F 11/04; B66F 9/20
USPC ..... 187/223, 227, 300, 313, 391–393; 340/505, 506, 518, 522, 541, 565
See application file for complete search history.

(56) References Cited

U.S. PATENT DOCUMENTS

| | | | | |
|---|---|---|---|---|
| 4,598,797 | A * | 7/1986 | Schultz | 187/223 |
| 5,379,655 | A * | 1/1995 | Yeakle | 73/865.7 |
| 5,906,648 | A * | 5/1999 | Zoratti et al. | 701/50 |
| 6,202,797 | B1 * | 3/2001 | Skolnick et al. | 187/317 |
| 6,550,585 | B2 * | 4/2003 | Schoppa et al. | 187/391 |
| 6,615,953 | B1 * | 9/2003 | Steinweg | 187/393 |
| 6,991,067 | B2 * | 1/2006 | Dube et al. | 187/223 |
| 7,194,358 | B2 * | 3/2007 | Callaghan et al. | 701/301 |
| 7,954,606 | B2 * | 6/2011 | Tinone et al. | 187/384 |
| 7,971,295 | B2 * | 7/2011 | Dippl et al. | 5/611 |
| 2001/0013307 | A1 * | 8/2001 | Stone | 108/147 |
| 2005/0270147 | A1 * | 12/2005 | Lewis | 340/439 |
| 2013/0187785 | A1 * | 7/2013 | McIntosh et al. | 340/686.6 |

* cited by examiner

*Primary Examiner* — Anthony Salata
(74) *Attorney, Agent, or Firm* — Kenneth DeRosa; Law Offices of Robert F. Zielinski LLC

(57) ABSTRACT

A safe-zone sensing system for a lift having a base, a lift platform, and a driving system for raising and lowering the lift platform. The safe-zone sensing system includes a sensor system having a plurality of sensors mounted to the base of the lift. The sensors collectively defining a safe-zone around the base of the lift and detecting motion or obstructions within the safe zone, a controller fires the sensors in a preselected sequence for continuously scanning the safe zone. Scanning is started when the platform raises above a preselected height. The sensor controller generates an alert which initiates a safety sequence when motion or obstructions are sensed by at least one of the plurality of sensors.

15 Claims, 6 Drawing Sheets

SAFE ZONE DETECTION SYSTEM FOR LIFT HAVING A PLUARLITY OF SENSORS

CROSS-REFERENCE TO RELATED APPLICATION

This application claims the benefit of U.S. provisional application No. 61/538,696 filed on Sep. 23, 2011, whose entire disclosure is hereby incorporated by reference.

STATEMENT REGARDING FEDERALLY SPONSORED RESEARCH OR DEVELOPMENT

The present invention was not developed with the use of any Federal Funds, but was developed independently by the inventor.

BACKGROUND

1. Field

The invention relates generally to safe-zone sensing systems and, more particularly, to a safe-zone sensing system that effects detection of motion and obstructions in a zone around the entire area of a lift.

2. Background

There are many uses for vertical lifts, including in large retail establishments and warehouses, where inventory may be stored on high shelves and the like, and the vertical lifts are thus in use near customers. As such, it may be desirable to ensure that the area beneath and around the lift is clear from obstructions before lowering the platform. It is also advantageous to ensure that the area is clear from boxes, products, and the like, to prevent damage to both the obstruction and the lift platform.

The above references are incorporated by reference herein where appropriate for appropriate teachings of additional or alternative details, features and/or technical background.

SUMMARY

A safe-zone sensing system for a lift having a base, a lift platform, and a driving system for raising and lowering the lift platform. The safe-zone sensing system comprises a sensor system having a plurality of sensors mounted to the base of the lift. The sensors collectively defining a safe-zone around the base of the lift and detecting motion or obstructions within the safe zone, a controller fires the sensors in a preselected sequence for continuously scanning the safe zone. Scanning is started when the platform raises above a preselected height. The sensor controller generating an alert which initiates a safety sequence when motion or obstructions are sensed by at least one of the plurality of sensors.

The sensor controller may be in communication with the drive system of the lift and wherein the controller stops the drive system from further lowering of the platform of the lift during the safety sequence when motion or obstructions are sensed by at least one of the plurality of sensors. An alert device may be included which alerts which alerts people during the safety sequence when motion or obstructions are sensed by at least one of the plurality of sensors.

BRIEF DESCRIPTION OF THE DRAWINGS

The embodiments will be described in detail with reference to the following drawings in which like reference numerals refer to like elements wherein.

DETAILED DESCRIPTION

Figure 1:
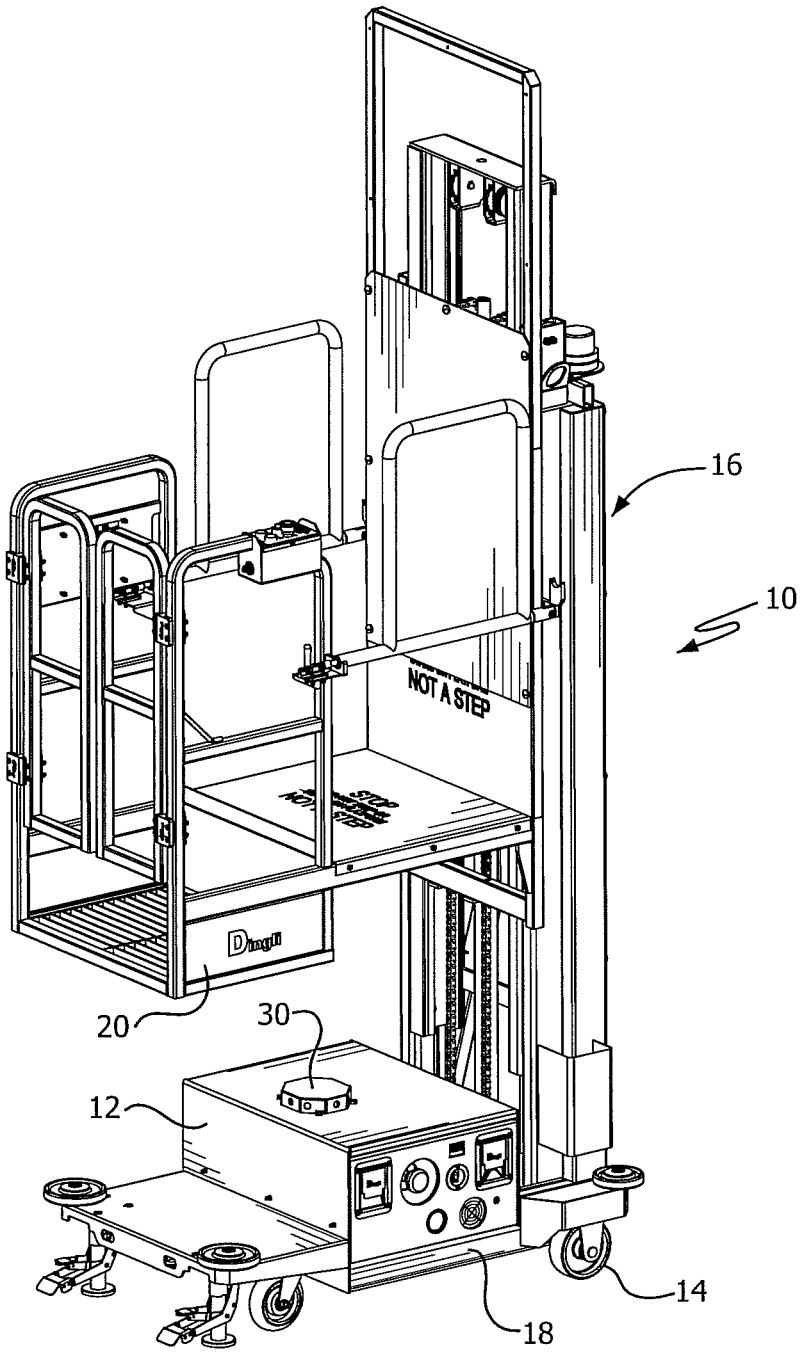
FIG. 1 is an isometric view of a lift in a lowered position with the safe-zone sensing system according to the present invention.
Figure 2:
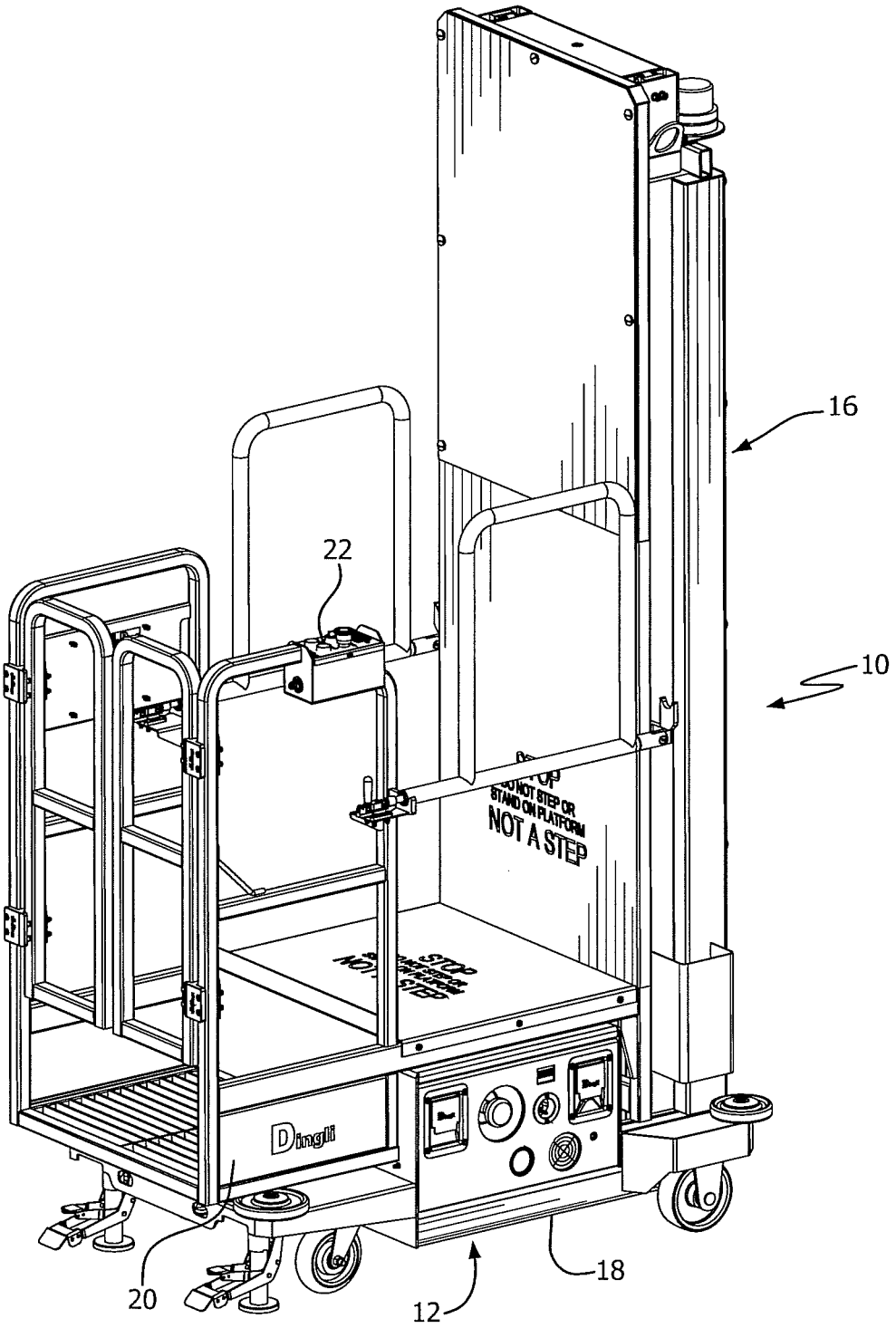
FIG. 2 is an isometric view of the lift in a partially raised position.

As shown in FIGS. 1 through 6, a lift 10 typically includes a chassis or base 12 mounted on wheels 14, a boom or lift assembly 16, a drive system and controller 18 mounted to the base 12, a vertically movable platform 20 that also likely has lift controls 22. A safe-zone sensing system 30 according to the present invention for the lift 20 is also shown. In FIG. 1 the lift 10 is shown in a partially raised position and in FIG. 2 the lift is shown in a lowered position.

Figure 3:
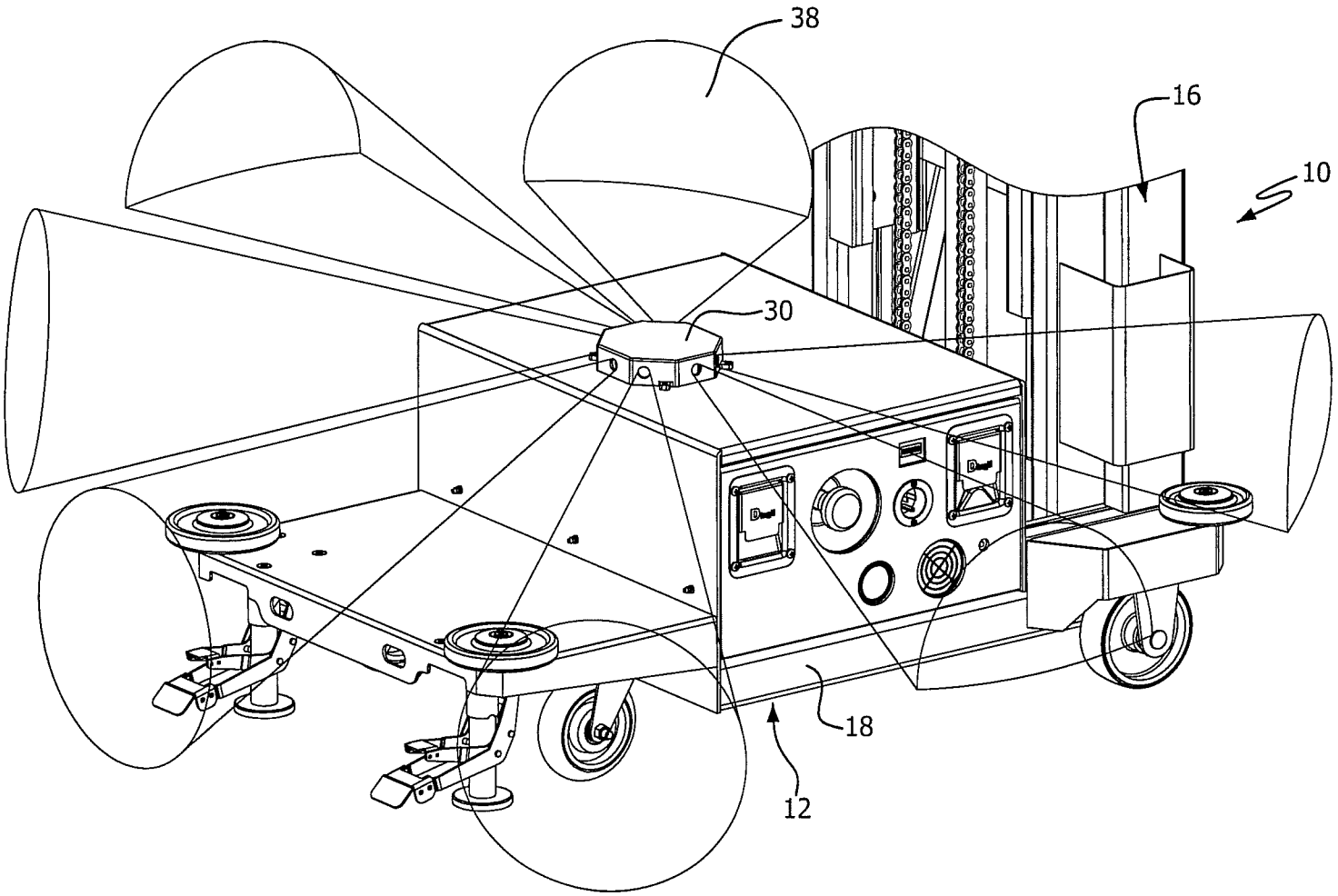
FIG. 3 is a partial isometric view of the lift and sensing system of FIG. 1.
Figure 4:
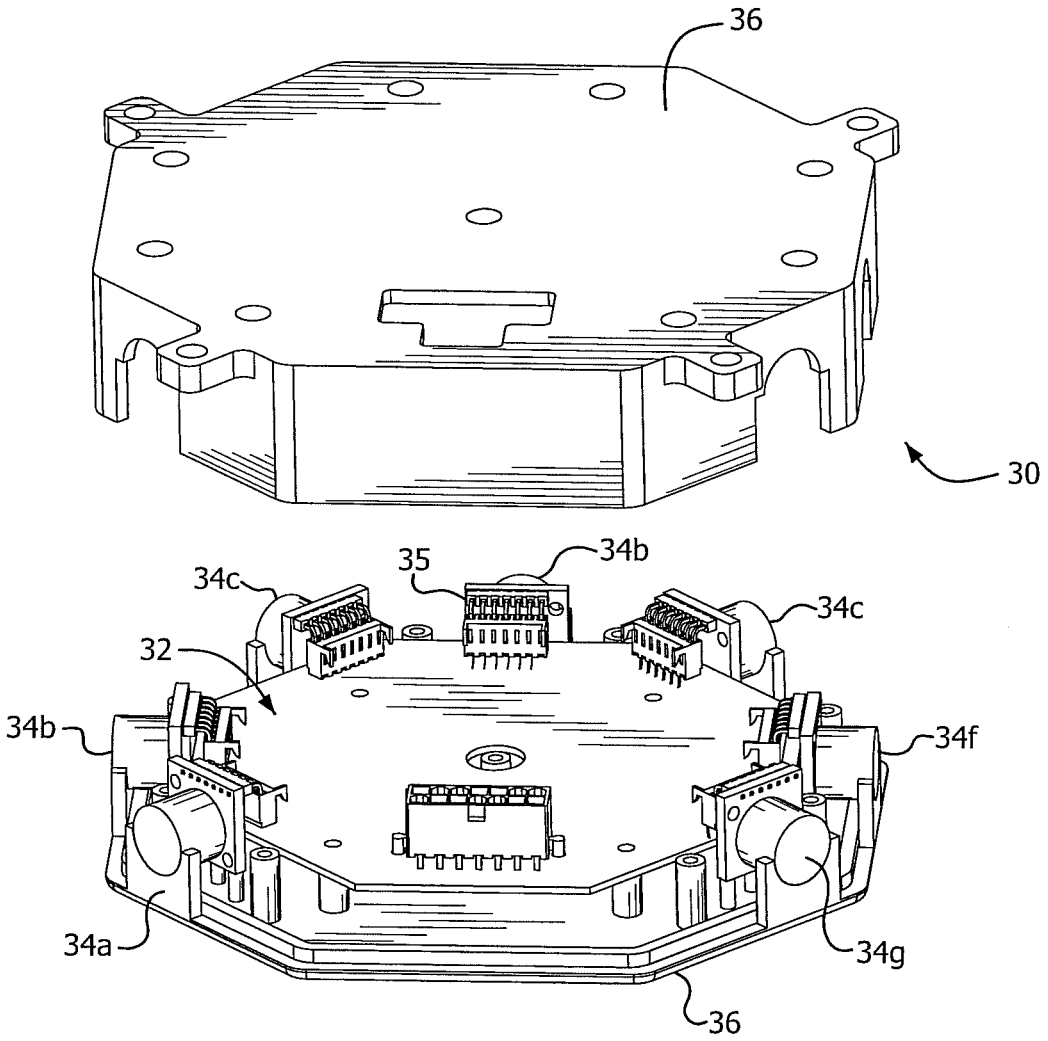
FIG. 4 is an isometric view of the sensing system of FIG. 1.
Figure 6:
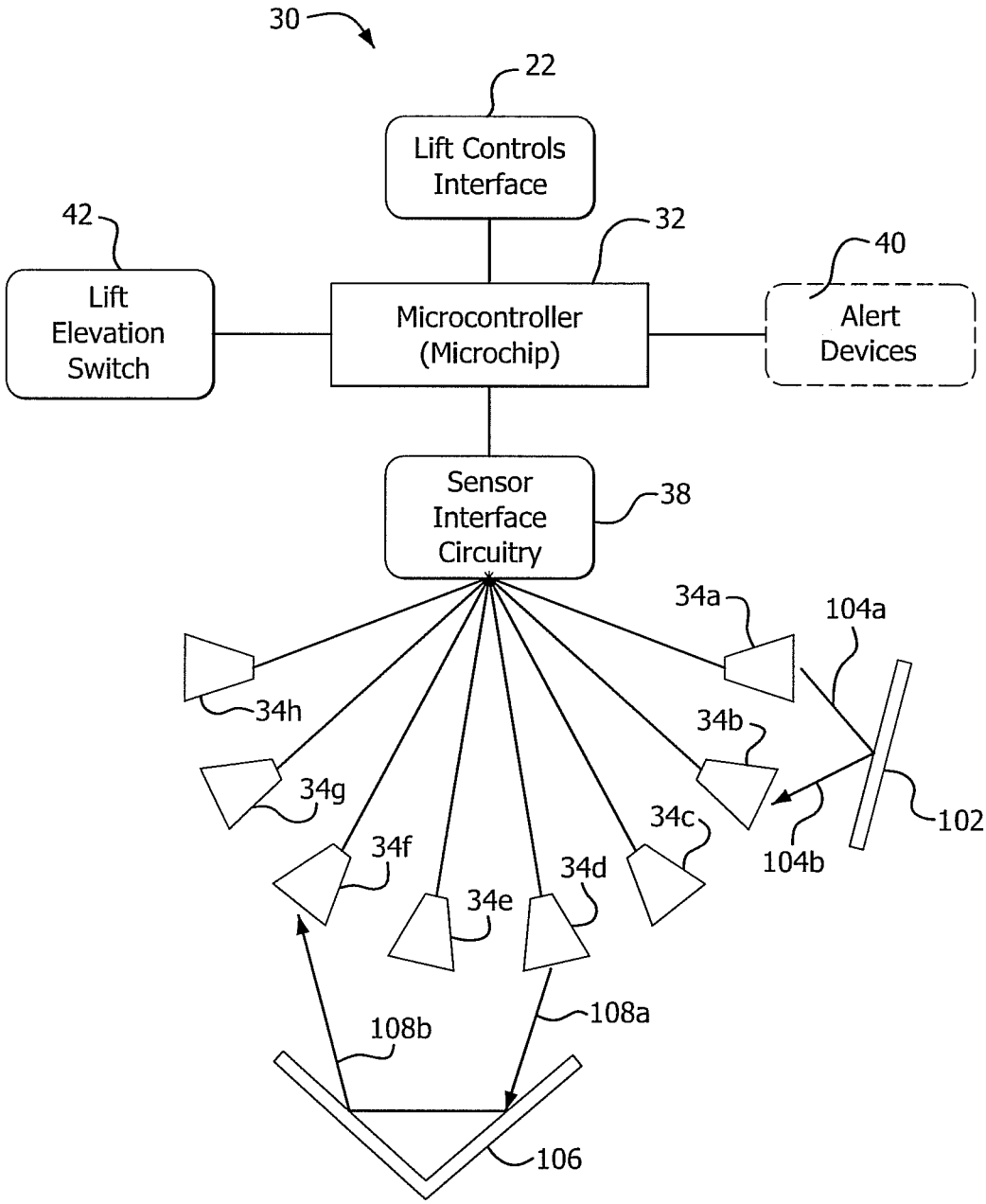
FIG. 6 is a schematic view of the sensor components.

As best seen in FIGS. 3 and 4, the safe-zone detecting system 30 comprises a microcontroller 32 communicating with a plurality of sensors 34*a-g*, such as ultrasonic transducers. The transducers 34*a-g* are disposed around the periphery of a durable housing 36 which containers both the transducers 24*a-g* and the microcontroller 32. There is a processor 35 for each sensor that monitors the intrusions in each of the seven (7) directions monitored by the sensors 34*a-g*, or the full eight (8) directions as shown in FIG. 6.

Their firing (scanning) sequence, such as sequentially or alternating sequentially, is controlled by a common processor 32. There is a specific scanning sequence to avoid one sensor form interfering with another. One such sequence is, referring to FIG. 6. sensor 34*c*, sensor 34*f*, sensor 34*a*, sensor 34*d*, sensor 34*g*, sensor 34*b*, sensor 34*c*, and optionally sensor 34*h* fired at 10 ms intervals. The safe-zone detecting sensing system 30 is mounted to the top side of the base 12 to sense the entire area around the base 12 and extending to a preselected radius as shown by the cones 38 beyond the area around the base 12.

Figure 5:
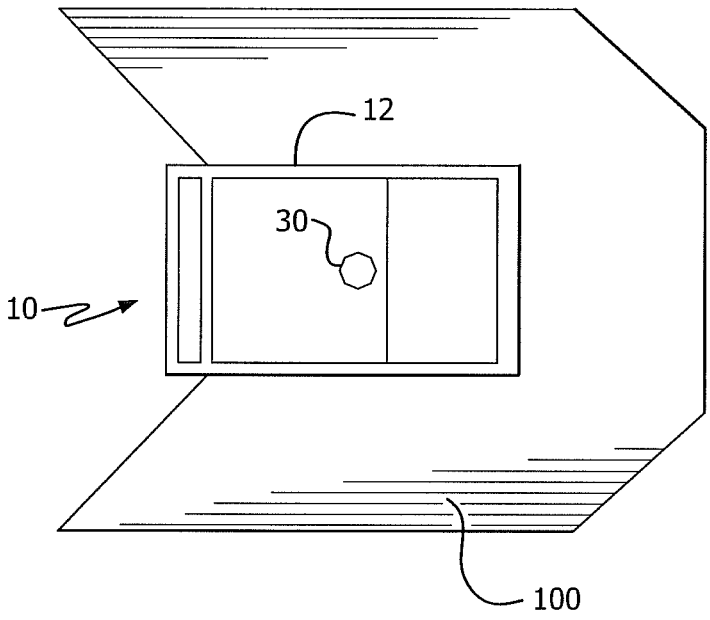
FIG. 5 is a top view of the lift and sensing system of FIG. 1.

The safe-zone detection system 30 preferably uses ultrasonic technology to detect objects on or in the immediate vicinity of the lift base 12 defined by safe-zone 100 as shown in FIG. 5. The ultrasonic sensors 34*a-g* detect objects as small as one inch in diameter up to 20 inches from the center of the base 12 with a one-inch accuracy and they survey the safe zone at the rate of 4 times per second. When an object is detected within the safe zone 100, an alert device 40, such as an audial alerting device (e.g., a beeper) and/or a visual alerting device, (e.g. a light) are turned on to alert personnel of the intrusion and the power unit 18, which may comprise a lowering solenoid, is disabled to prevent the lift platform 20 from lowering. The lowering solenoid is automatically re-enabled after the safe zone 100 is clear for a preselected period, such as about 15 seconds. The safe zone detection system 10 can be manually reset by cycling the main power, i.e., turning the key switch off then back on or pressing the emergency stop button and turning it back on.

The safe-zone detection system 30 preferably contains a series of transducers 34*a-g* mounted to the top surface of the base 12. The sensors are fired sequentially with a preselected timing between the sensors. Each transducer in sequence sends out an ultrasonic signal, and the other transducers listens for a reflection as shown schematically in FIG. 6.

In this way the sensors can detect objects from about 68 inches to about 136 inches as the refection of one sensor gets received or detected by one of the remaining sensors in the sequence, such as the next adjacent sensor or the sensor adjacent to the next sensor. For example, as best shown in FIG. 6, if a signal 104*a* from the transducer 34*a* strikes a flat obstruction 102, the reflection 104*b* is typically received by the adjacent transducer 34*b*. Similarly, if a signal 108*a* from the transducer 34*d* strikes a corner obstruction 106, the reflection 108*b* is typically received by the second adjacent transducer 34*f*. In any event, as long as the reflection of a signal from one sensor is detected by any one of the sensors within the preselected safe-zone, an obstruction in the safe-zone will be detected.

Any suitable sensor can be incorporated into the safe-zone sensing system 30 of the invention, and the invention is not meant to be limited to a particular transducer. An example of a suitable transducer. LV-MaxSonar—EZ1 High Performance Sonar Range Finder is available from MaxBotix Inc. This transducer provides very short to long-range detection. It is capable of detecting objects from 0 to 254 inches and provides sonar range information from 6 to 254 inches with 1 inch resolution. The interface output formats included are pulse width output, analog voltage output, and serial digital output. Of course, the invention may also be used with sensors other than ultrasonic transducers, provided they are suitable for the described purpose.

FIG. 6 is a schematic diagram for the safe-zone sensing system 30 according to the invention. A microprocessor 32, via sensor interface circuitry 38, controls the operation of the system based on signals from the ultrasonic transducers 34*a-h* mounted to the base 12. In a preferred embodiment, the system is only active during platform descent, and the lift up signal from the lift elevation switch 42 of the control panel 22 is received by the microprocessor 32, which activates the components to effect platform lift. When an operator moves the controls to initiate a lift down signal via 42, the microprocessor 32 polls the ultrasonic transducers 34*a-g* to determine if there is an obstruction beneath the platform.

If there is no obstruction, the microprocessor 32 activates the lift down function via a lift elevation switch 42, such as a lift down solenoid or the like. If the ultrasonic transducers 34*a-h* detect an obstruction before or during the lift down function, the microprocessor 32 prevents further lowering of the platform by switch 42, and the microprocessor 32 activates the alert devices 40.

By means of the present invention, the safe-zone detecting system 32 establishes a defined safe zone 100 around the lift 10 using ultrasonic technology. Motion or obstructions within the safe zone 100 will trigger an alert via the alerting devices 40, a predefined sequence of steps, to manage the safety of the area when the lift is elevated more than approximately two feet. The sequence of steps may include: alarms, visual and/or audio, jift operation lock out, unlock/cancel sequence, and others as required.

The safe-zone detecting system 32 effects a high speed scanning system uses highly reliable ultrasonic technology that continuously scans the safe zone for intrusions. Preferably Sensing is initiated when the lift platform has elevated approximately 22", though it should be understood that other heights also fall within the scope of the invention, including when the lift is in the lowered position shown in FIG. 1. The reason for waiting for a certain lift elevation before turning on/off the sensor is to avoid detecting the lift platform and interpreting it as an intrusion into the safe zone. The particular height is based on the size of the platform and the cone angle of the view of the sensors.

In operation, when the lift platform 20 rises above a preselected elevation, the system is powered on. During power up, the system measures the distance to the objects in the vicinity of the lift 10, the safe zone 100, a predetermined distance from the lift, and stores those distances. The system continuously measures the distance to the objects in the safe zone. Measurements are compared to those stored. If an object is determined to have moved closer to the lift or an object is detected that was not previously measured within the safe zone, an alert is triggered and a predetermined sequence of operations is initiated. The system then manages the clearing of the alert. When the lift lowers to less than the predetermined elevation, the system powers off.

The obstruction sensing system according to the present invention effects safe operation of a lift vehicle lift platform by detecting motions and obstructions in the traveling path of the lift platform during platform descent. Upon detection of an obstruction, further descent of the platform is prevented, thereby protecting the lift as well as the obstruction itself. Of course, the safe-zone sensing system according to the invention may apply to various types of industrial machinery and not just the exemplary vertical lift shown in FIGS. 1 and 2. For example, the system may apply to other aerial lifts working in a sensitive environment where the items sensed are at some predetermined horizontal distance from the encroaching surface of the machine (e.g., aircraft assembling machine or other such apparatus, and the like.). The system may also be used on all surfaces of a fully enclosed moving structure where contact may occur with other sensitive surfaces Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A safe-zone sensing system for a lift, the lift having a base, a lift platform, and a driving system for raising and lowering the lift platform, the safe-zone sensing system comprising:

a sensor system comprising a housing containing a plurality of sensors configured to be mounted to a top surface of the base of the lift, the sensors collectively define a safe-zone disposed around the base of the lift and detecting motion or obstructions within the safe zone, a controller fires the sensors in a preselected sequence to continuously scan the safe zone, the scan operation is started when the platform raises above a preselected height, during the scan operation one of the plurality of sensors if motion or an obstruction is detected, the sensor controller generates an alert which initiates a safety sequence when motion or obstructions are sensed by at least one of the plurality of sensors.

2. The safe-zone sensing system according to claim 1 further comprising:

an alert device which alerts during the safety sequence when motion or obstructions are sensed by at least one of the plurality of sensors.

3. The safe-zone sensing system according to claim 1 wherein the sensor controller is in communication with the drive system of the lift and wherein the controller stops the drive system from further lowering of the platform of the lift during the safety sequence when motion or obstructions are sensed by at least one of the plurality of sensors.

4. The safe-zone sensing system according to claim 3 further comprising:

an alert device which alerts during the safety sequence when motion or obstructions are sensed by at least one of the plurality of sensors.

5. The safe-zone sensing system according to claim 1 wherein the sensors are ultrasonic sensors.

6. The safe-zone sensing system according to claim 1 wherein the height is about 22 inches and the sensor system powers on when the platform reaches the height.

7. The safe-zone sensing system according to claim 1 wherein the sensor system measures the distance to objects in the safe zone and stores these distances, the sensor system continuously measures the distance to the objects, the measurements are compared to those stored, if an object is determined to have moved closer to the lift or an object is detected that was not previously measured within the safe zone, an alert is triggered and a predetermined sequence of operations is initiated.

8. A lift vehicle comprising:

a base, a lift platform, and a driving system for raising and lowering the lift platform; and a sensor system comprising a housing containing a plurality of sensors mounted to a top surface of the base of the lift, the sensors collectively define a safe-zone disposed around the base of the lift and detecting motion or obstructions within the safe zone, a controller fires the sensors in a preselected sequence to continuously scan the safe zone, the scan operation is started when the platform raises above a preselected height, during the scan operation one of the plurality of a sensors sends out a signal and the signal is received by another of the plurality of sensors if motion or an obstruction is detected, the sensor controller generates an alert which initiates a safety sequence when motion or obstructions are sensed by at least one of the plurality of sensors.

9. The lift vehicle according to claim 8 further comprising:

an alert device which alerts during the safety sequence when motion or obstructions are sensed by at least one of the plurality of sensors.

10. The lift vehicle according to claim 8 wherein the sensor controller is in communication with the drive system of the lift and wherein the controller stops the drive system from further lowering of the platform of the lift during the safety sequence when motion or obstructions are sensed by at least one of the plurality of sensors.

11. The lift vehicle according to claim 10 further comprising:

an alert device which alerts during the safety sequence when motion or obstructions are sensed by at least one of the plurality of sensors.

12. The lift vehicle according to claim 8 wherein the sensors are ultrasonic sensors.

13. The lift vehicle according to claim 8 wherein the height is about 22 inches and the sensor system powers on when the platform reaches the height.

14. The lift vehicle according to claim 8 wherein after power on the sensor system measures the distance to objects in the safe zone and stores these distances, the sensor system continuously measures the distance to the objects, the measurements are compared to those stored, if an object is determined to have moved closer to the lift or an object is detected that was not previously measured within the safe zone, an alert is triggered and a predetermined sequence of operations is initiated.

15. The lift vehicle according to claim 8 wherein the sensor system is mounted to the base of the lift.

* * * * *